US006869567B2

(12) United States Patent
Kretchmer

(10) Patent No.: US 6,869,567 B2
(45) Date of Patent: Mar. 22, 2005

(54) MAGNETIC PLATINUM ALLOYS

(76) Inventor: Steven Kretchmer, Rte. 23 A, P.O. Box G, Palenville, NY (US) 12463

( * ) Notice: Subject to any disclaimer, the term of this patent is extended or adjusted under 35 U.S.C. 154(b) by 33 days.

(21) Appl. No.: 10/435,695

(22) Filed: May 9, 2003

(65) Prior Publication Data

US 2003/0215351 A1 Nov. 20, 2003

Related U.S. Application Data

(60) Provisional application No. 60/381,000, filed on May 15, 2002.

(51) Int. Cl.[7] ..... C22C 5/04; H01F 1/04

(52) U.S. Cl. ..... 420/466; 148/300; 63/20; 63/12; 63/3

(58) Field of Search ..... 420/466; 148/300; 63/15, 15.9, 20, 12, 3

(56) References Cited

U.S. PATENT DOCUMENTS

| | | | | |
|---|---|---|---|---|
| 3,444,012 A | | 5/1969 | Shimizu et al. | 148/101 |
| 3,591,373 A | | 7/1971 | Shimizu et al. | 75/172 |
| 3,755,796 A | | 8/1973 | Griest, Jr. | 340/174 |
| 3,860,458 A | | 1/1975 | Inoue et al. | 148/120 |
| 3,887,401 A | * | 6/1975 | Hetzel | 148/121 |
| 3,961,946 A | | 6/1976 | Makino et al. | 75/172 |
| 4,221,615 A | | 9/1980 | Shine | 148/120 |
| 4,396,441 A | | 8/1983 | Masumoto et al. | 148/101 |
| 4,451,811 A | | 5/1984 | Hoffman | 335/302 |
| 4,536,233 A | | 8/1985 | Okonogi et al. | 148/101 |
| 4,563,330 A | | 1/1986 | Narasimhan et al. | 420/435 |
| 4,650,290 A | | 3/1987 | van Engen et al. | 350/376 |
| 4,853,048 A | | 8/1989 | Shimizu et al. | 148/300 |
| 4,893,980 A | | 1/1990 | Balter | 4141/3 |
| 4,983,230 A | | 1/1991 | Overfelt et al. | 148/300 |
| RE35,511 E | | 5/1997 | Nakamura | 63/14.1 |
| 5,921,110 A | | 7/1999 | Middendorff et al. | 63/1.11 |
| 6,171,410 B1 | | 1/2001 | Kojima et al. | 148/302 |
| 6,282,760 B1 | | 9/2001 | Mars | 24/303 |

OTHER PUBLICATIONS

Merriam–Webster's Collegiate Dictionary, 10th Ed. Merriam Webster Inc., 1999.*

Lester Moskowitz, Permanent Magnet Design and Application Handbook, A New Approach to the Study of Permanent Magnets, Robert E. Kriegen Publishing Co. (1976).

R. F. Vires, The Platinum Metals and Their Alloys. The International Nickel Company, Inc. (1941).

Article, A sesssed Co–Pt. phase diagram, Copyright 9C) 1996 International.

* cited by examiner

*Primary Examiner*—George Wyszomierski
*Assistant Examiner*—Janelle Morillo
(74) *Attorney, Agent, or Firm*—Winston & Strawn LLP

(57) ABSTRACT

A new jewelry component alloy and articles of jewelry formed therefrom wherein the components and articles include precious metal alloys of platinum and cobalt that have magnetic properties and high hardnesses so that the various forms of fine jewelry that possess new and unusual visual and functional properties. When these alloys are formed into jewelry articles or components, the magnetic properties enable the components to either be attracted to or repelled by other components of different or like polarities. The jewelry designer is thus able to create pieces with levitating or suspended components, or to make magnetically connected components. The high hardness imparts exceptional durability to these components.

15 Claims, No Drawings

MAGNETIC PLATINUM ALLOYS

This application claims benefit of U.S. Provisional Application No. 60/381,000, filed May 15, 2002.

TECHNICAL FIELD

The present invention relates to platinum alloys that can provide appropriate magnetic properties and exceptional hardness and wear-resistance for fine jewelry. These precious metal alloys are useful for fine jewelry where the magnetic properties enable extraordinary effects such as levitation, attraction, and repulsion to be achieved in lustrous, enduring fine jewelry pieces of great beauty that possess a sophisticated appearance.

BACKGROUND ART

Magnetic materials are well known in the art. Many of these materials are relatively inexpensive iron based alloys that can be permanently magnetized and then utilized as magnets to provide attraction or repellant magnetic forces in a wide variety of articles and devices. Other alloys are also known. One particular conventional alloy known as Alnico contains iron (Fe), nickel (Ni), aluminum (Al) and cobalt (Co), while another, known as Vicalloy, includes Fe, Co and Vanadium (V). One typical use of magnets is disclosed in U.S. Pat. No. 4,893,980 wherein inner and outer samarium (Sm)—Co magnets are used to impart sliding movement to a component of the device, while another use of such magnets is disclosed in U.S. Pat. No. 4,451,811.

Most of the current applications for magnets in jewelry items are generally for simple attachment of two components so that the item can be attached to clothing or ear piercing. For example, U.S. Pat. No. Re-35,511 discloses the use of common magnets to join two separate portions of an earring together (see FIG. 10), while U.S. Pat. Nos. 6,282,760 and 5,921,110 disclose using complementary magnets for attaching jewelry items to each other and to support devices, particularly for attachment of the items to clothing.

Traditionally, fine jewelry pieces are made of valuable precious metals or alloy materials thereof These materials are based on gold, silver, palladium, platinum, rhodium, and lustrous alloys of these materials. Certain alloys may be heat-treated to increase strength or hardness, but generally these alloys are not magnetized. Certain of these alloys have no magnetic properties at all while the magnetic properties of others have not been utilized in fine jewelry pieces.

Magnetic alloys are very atomically structured and are inherently brittle. When magnetic alloys are thin, they are fragile. Small, thin components for jewelry made from magnets, including known precious metal magnets are too brittle for everyday use for jewelry. In fact, for jewelry, only thick magnetic parts have been inlayed or set in place in jewelry to utilize the forces from their magnetic fields. Consequently, magnetic alloys have very limited, non-aesthetic uses in jewelry applications. And while there have been precious metal magnetic materials, they have not been applied to fine jewelry.

U.S. Pat. No. 4,853,048 discloses that a known precious metal magnet of platinum-cobalt (Pt—Co) has equal atomic amounts of Pt and Co (representing about 77 weight percent Pt and 23 weight percent Co), but rejected its use stating that is has "little value" in jewelry because its Pt content is below 85 weight percent. To make a jewelry component, their resolution of the problem was to add gold (Au) to form a ternary Au—Pt—Co alloy that contains 50 to 75% Au, 12 to 42% Pt and 2 to 15% Co. Also, small amounts of Fe, Ni, copper (Cu), palladium (Pd), and silver (Ag) can be added to modify the properties of the ternary alloy. It was suggested that the resultant alloy material could be formed into a chain that can be magnetized in the direction of its thickness.

The magnetic properties of other alloys that contain precious metals have been investigated in a number of patents. U.S. Pat. No. 4,221,615 discloses soft-magnetic (i.e., non-permanent magnet) Pt—Co alloy products. U.S. Pat. No. 3,860,458 discloses a magnetic material consisting essentially of 40 to 60 atomic percent Pt, 45 to 55 atomic percent Co, and between 4 and 15 atomic percent iron alone or with up to 5 atomic percent Ni, and optionally with up to 5 atomic percent Cu. U.S. Pat. No. 4,983,230 discloses magnetic alloys formed from Pt, Co, and Boron (B). U.S. Pat. No. 3,591,373 discloses a permanent magnetic alloy comprising 15–40 atomic percent Pt, 5–35 atomic percent Au and 40 atomic percent Fe. U.S. Pat. No. 3,755,796 discloses Co alloys that contain one of arsenic (As), germanium (Ge), indium (In), osmium (Os), Pt, rhodium (Ro), rhenium (Rh), ruthenium (Ru), silicon (Si), or Ag. U.S. Pat. No. 3,444,012 discloses Pt—Fe alloys that contain Co, Ni, H, Au, Ag, Cu, Iridium (Ir), Os, Pd, or Rh can be heat treated to provide magnetic properties, while U.S. Pat. No. 4,396,441 discloses permanent magnets of Pt—Fe alloys. U.S. Pat. No. 4,650,290 discloses a magneto-optical layer of a Pt-manganese-antimony alloy. U.S. Pat. No. 3,961,946 discloses magnetic Pt—Ni and Pt—Ni—Co alloys. U.S. Pat. No. 4,536,233 discloses permanent magnets of Sm—Co—Cu—Fe that also contain zirconium, titanium, hafnium, tantalum, niobium, and vanadium. Finally, U.S. Pat. No. 6,171,410 discloses hard (or permanent) magnetic alloys of Fe, Co or Ni, with a rare earth element and B. In these patents, however, none of the properties or usefulness of these alloys for jewelry applications was investigated or discussed.

Also, while British patent GB-1,067,054 discloses various heat treatments for Pt—Co alloys, it does not discloses any uses of such heat-treated materials in jewelry applications.

The present inventor has found that there is a need for new fine jewelry items that have unique properties and ornamental appearances, and that he has discovered new uses for certain known precious metal alloys for this need.

SUMMARY OF THE INVENTION

The invention relates to a jewelry component of a magnetic platinum alloy comprising platinum and cobalt in amounts effective to enable the alloy to create the appropriate magnetic force fields for use in jewelry. The alloy includes magnetic strengths that are sufficient to repel or attract other magnetic or magnet-responsive components appropriately for jewelry. These alloys also provide superb and heretofore unknown wear-resistance for jewelry articles. Advantageously, the platinum and cobalt are present in a weight ratio of 70:30 to 95:5 with the platinum preferably being present in an amount of about 75 to 80 weight percent and the cobalt preferably being present in an amount of about 20 to 25 weight percent. A most preferred alloy is known as POLARIUM® and is available from the inventor.

It is sometimes desirable to reduce the magnetic strength of the alloy so that it does not detrimentally affect other magnetic or magnet-responsive components. If desired, a jewelry component made of this alloy can be demagnetized sufficiently. A typical magnetic strength of the alloy is from about 200 to 4500 gauss and preferably about 600 to 2000 gauss, and it has a Rockwell 15T hardness of about 80 to about 95.

The invention also relates to an article of jewelry comprising at least one component made of the magnetic platinum alloy described herein. Generally, the article has a decorative shape, such as a ring, heart or other shape and preferably includes at least one of a stone mounting, a post, a clasp, piece, or a connector. Preferably, the article includes at least two components of different magnetic polarities, configured such that one component is attracted to the other, or of at least two components of the same magnetic polarity so that one component repels the other, or combinations thereof. These properties impart novel visual and functional characteristics to various forms of fine jewelry including finger or toe rings, bracelets or necklaces, ankle or belly chains, earrings, pendants, brooches, or clasps.

Yet another embodiment of the invention relates to a method of making an article of jewelry which comprises forming a jewelry component by heat treating one of the platinum-cobalt alloys mentioned above, and incorporating one or more of such components to form an article of jewelry. Generally, at least two jewelry components are provided, wherein each has different magnetic polarities such that one component is attracted to the other, or each has the same magnetic polarity so that one component repels the other. As noted above, the magnetic strength of the alloy can be reduced so that it does not affect other objects that can be damaged due to contact with high or strong magnetic fields.

DETAILED DESCRIPTION OF THE PREFERRED EMBODIMENTS

The invention is directed to the use of certain precious metal alloys that are treated to develop magnetic properties and high hardness so that the alloy is ideally suited for making various forms of jewelry that provide new and unusual visual and functional properties. When the alloy is formed into jewelry articles or components, the magnetic properties enable the components to either be attracted to or repelled by other components of different or like polarities. This, in turn, enables the jewelry designer to create pieces with levitating or suspended components, or to make magnetically connected components. A wide range of new precious metal jewelry components can now be made with heretofore unknown magnetic properties.

These alloys are platinum based and contain at least about 70% platinum by weight. While amounts as high as 95% by weight are suitable, the a preferred amount is between 75 and 80 % by weight and most preferably it is between 76 and 78%, as these amounts enable the strongest magnetic properties to be achieved.

In order to impart magnetic properties to these alloys, cobalt is added. The amount of cobalt can range from about 5 to 30 % by weight, and is complementary to the weight of the platinum. As between these two components, a weight ratio of 70:30 to 95:5 Pt:Co is preferable, with the most preferred amount of cobalt in the alloy being 22–24%.

The alloy can be heat treated by conventionally solution treating the alloy followed by quenching and then heat aging until the desired hardnesses are obtained. The heating steps are conducted in an inert atmosphere. One of ordinary skill in the art can determine, by routine testing, the appropriate temperatures and times to achieve the desired combination of hardness and magnetic properties in the alloy. The heat treatments disclosed in British patent 1,067,054 can be used, if desired, for imparting preferred hardnesses to these alloys. After heat treatment, magnetic properties are imparted to the alloy by conventional techniques to achieve the desired values.

As noted above, a 77Pt—23Co alloy (with a content of 76 to 78% Pt and 22 to 24% Co) is generally known in the alloy art. Although it may be brittle in very thin sections, it can be utilized in thicker sections or as an insert into a structural bearing member of the article.

As noted above, the preferred magnetizable alloy for use in these jewelry components is a 77% Pt 23% Co alloy. This alloy can be heat treated after forming into a desired shape to magnetize it. The resulting heat-treated material is provided with a magnetic strength of between 650 and 2000 Gauss as measured by a Model 7010 Gauss/Teslameter by F. W. Bell Technologies, utilizing a Hall Effect probe. These preferred alloys also have a Rockwell T15 hardness of 87 to 92. An example of this material is known as POLARIUM® and is available from the inventor. This alloy is preferred for fine jewelry because it has greater magnetic power than known magnetic gold alloys.

When providing certain alloys of the desired hardness, it is possible that the magnetic strengths can be too strong. As jewelry pieces such as finger rings can come into contact with computer diskettes or other items that can be damaged by a high magnetic field, the designer should take care to control the magnetic field strength of the component. One way to do this is to control the heat treatment so that only minimum magnetic properties are achieved.

Alternatively, a magnetic property reducing method can be used by increasing the platinum in the platinum-cobalt alloy proportion in small amounts sufficient to reduce the magnetic properties of the alloy appropriately without significantly reducing its desired hardness. This enables the desired magnetic properties and high hardness to be achieved together, as is necessary or desired for many end use applications for the jewelry components.

A wide range of jewelry articles can be made, including finger or toe rings, belly chains, ankle chains, earrings, pendants, brooches, bracelets, clasps, or necklaces. The components can be configured in just about any shape, including round, oval or polygonal, or as a chain or rope. They can have imbedded stones, or stone mountings, inlays or other different color enhancements, or can be combined or matched with other precious metal components to make the jewelry piece.

The magnetic properties enable the jewelry components to be attracted to each other when they have different polarities, or to repel each other when having the same polarities, or combinations thereof. With these properties, a variety of unusual visual and functional effects can be achieved, limited only by the creativity and ingenuity of the designer.

What is claimed is:

1. A method of making an article of jewelry which comprises forming at least two jewelry components of magnetic platinum-cobalt alloy wherein the platinum and cobalt are present in a weight ratio of 70:30 to 95:5 and each component has a magnetic strength of about 200 to 4500 gauss and a Rockwell 15T hardness of about 80 to about 95; and magnetically associating the components in an article of jewelry so that the magnetic platinum-cobalt alloy components can provide magnetically responsive features to form the article of jewelry, wherein the article of jewelry is configured in the form of a finger or toe ring, an earring, a pendant, a brooch, a bracelet or a necklace.

2. The method of claim 1 which further comprises shaping the alloy to impart a decorative shape to at least one jewelry component of the article.

3. The method of claim 1 wherein at least one jewelry component of the article is in the form of a ring, a stone mounting, a post, a clasp, or a connector.

4. The method of claim 1 wherein the two jewelry components have different magnetic polarities such that one component is attracted to the other.

5. The method of claim 1 wherein the two jewelry components have the same magnetic polarity so that one component repels the other.

6. An article of jewelry which comprises at least one jewelry component made of a magnetic platinum-cobalt alloy wherein the platinum and cobalt are present in a weight ratio of 70:30 to 95:5 and having a magnetic strength of about 200 to 4500 gauss and a Rockwell 15T hardness of about 80 to about 95 so that the magnetic platinum-cobalt alloy can provide magnetically responsive features in the article, and wherein the article is configured in the form of a finger or toe ring, an earring, a pendant, a brooch, a bracelet or a necklace.

7. The article of claim 6 wherein the jewelry component is in the form of a ring, a stone mounting, a post, a clasp, or a connector.

8. The article of claim 6 wherein at least two jewelry components are provided and are in magnetic association.

9. The article of claim 8 wherein the two jewelry components have different magnetic polarities such that one component is attracted to the other.

10. The article of claim 8 wherein the two jewelry components have the same magnetic polarity so that one component repels the other.

11. A method of making an article of jewelry in the form of a finger or toe ring, an earring, a pendant, a brooch, a bracelet or a necklace which comprises forming a jewelry component of a magnetic platinum-cobalt alloy wherein the platinum and cobalt are present in a weight ratio of 70:30 to 95:5 and the component has a magnetic strength of about 200 to 4500 gauss and a Rockwell 15T hardness of about 80 to about 95; and incorporating the component in the jewelry article so that the magnetic platinum-cobalt alloy components can provide magnetically responsive features in the article.

12. The method of claim 11 wherein the jewelry component is in the form of a ring, a stone mounting, a post, a clasp, or a connector.

13. The method of claim 11 wherein at least one additional jewelry component is provided in magnetic association with the platinum cobalt jewelry component.

14. The method of claim 11 wherein the two jewelry components have different magnetic polarities such that one component is attracted to the other.

15. The method of claim 11 wherein the two jewelry components have the same magnetic polarity so that one component repels the other.

* * * * *